US007263736B2

(12) United States Patent
Goodman et al.

(10) Patent No.: US 7,263,736 B2
(45) Date of Patent: Sep. 4, 2007

(54) SAND DUNE BRIDGES AND METHODS OF PROTECTING SAND DUNES

(76) Inventors: Harold J. Goodman, 33 Hammock Dr., Manteo, NC (US) 27954; Michael L. Tierney, 6 Spinaker Dr., Manteo, NC (US) 27954

( * ) Notice: Subject to any disclaimer, the term of this patent is extended or adjusted under 35 U.S.C. 154(b) by 82 days.

(21) Appl. No.: 11/047,759

(22) Filed: Feb. 2, 2005

(65) Prior Publication Data

US 2005/0169708 A1 Aug. 4, 2005

Related U.S. Application Data

(60) Provisional application No. 60/540,571, filed on Feb. 2, 2004.

(51) Int. Cl.
*E01D 11/00* (2006.01)

(52) U.S. Cl. ..... 14/18; 14/78

(58) Field of Classification Search ..... 14/18, 14/19, 20, 78; 405/15
See application file for complete search history.

(56) References Cited

U.S. PATENT DOCUMENTS 467,013 A * 1/1892 Miller ..... 14/20
1,095,202 A * 5/1914 Friend ..... 14/19
2,417,825 A * 3/1947 Janke, Sr. ..... 14/3
3,953,980 A * 5/1976 Bennett ..... 405/221
4,457,035 A * 7/1984 Habegger et al. ..... 14/18
5,626,440 A * 5/1997 Greene et al. ..... 405/218

* cited by examiner

*Primary Examiner*—Gary S. Hartmann
(74) *Attorney, Agent, or Firm*—Millen, White, Zelano & Branigan, P.C.

(57) ABSTRACT

A sand dune bridge is configured with a suspension span which spans a sand dune from first pilings on a landward side of the dune to second pilings in or adjacent to a seaward side of the dune. A ramp extends from the second pilings to the beach. The ramp may also be in the form of a suspension bridge wherein step carriages are suspended intermediate the ends thereof so that pilings are needed only at the ends of the carriages. The suspension arrangement uses a pair of cables extending between the pilings with bridge decking supported on stringers which are attached to lateral beams suspended from hangers extending downwardly from the cables. The bridge decking and step treads have openings therethrough for the passage of sand, air and water.

19 Claims, 4 Drawing Sheets

SAND DUNE BRIDGES AND METHODS OF PROTECTING SAND DUNES

RELATED PATENT APPLICATIONS

This application claims priority from U.S. Provisional Application No. 60/540,571, filed Feb. 2, 2004 and incorporated herein by reference in its entirety.

FIELD OF THE INVENTION

The present invention is directed to sand dune bridges and to methods of protecting sand dunes. More particularly, the present invention is directed to sand dune bridges and to methods protecting sand dunes wherein the bridges are used to access a beach from an area landward of a sand dune.

BACKGROUND OF THE INVENTION

A general practice for accessing a beach from a landward area such as a dwelling site, parking lot, road, campground or any other landward area, is passage over pressure treated wooden walkways. Where there is a sand dune present, some wooden walkways simply rest on the dune and others are supported by a wooden piles that penetrate the dune itself and usually have a square cross section. It has been found that current bridging structures can themselves create erosion sites, which while usually protecting dunes, can result in dune breaches, which if not repaired widen, and eventually result in substantial sand dune destruction.

In addition, when beaches are subject to heavy surf and tidal surges, sand dune walkways and bridges of current designs are frequently destroyed and washed away. Moreover, dune walkways of current design tend to interfere with natural phenomenon that encourage the accretion of sand. This is because current walkways both retain sand particles on top of planks which are used for walking surfaces and create conditions underneath the walkways which can accelerate wind speed and thus cause local erosion beneath the walkways.

SUMMARY OF THE INVENTION

The present invention is directed to a suspension bridge used to cross a sand dune, wherein the suspension bridge includes first pilings disposed landward of the dune and a second pilings disposed seaward of a seaward face of the dune. Suspension cables are supported by the first and second pilings to suspend a bridge deck. A ramp extends from the seaward end of the bridge to the beach.

In a second aspect of the invention, a landward ramp extends from the first piling arrangement to an area on the landward side of the dune.

In a further aspect of the invention, the bridge deck has openings therethrough to prevent sand from accumulating on top of the bridge deck and to let air pass therethrough.

In still a further aspect of the invention, the pilings are round in cross section.

A method of the present invention comprises protecting dunes using suspension bridges in which decking and ramps do not directly contact the crests and faces of dunes.

BRIEF DESCRIPTION OF THE DRAWINGS

Various other features and attendant advantages of the present invention will be more fully appreciated as the same becomes better understood when considered in conjunction with the accompanying drawings, in which like reference characters designate the same or similar parts throughout the several views, and wherein.

DETAILED DESCRIPTION

Figure 1:
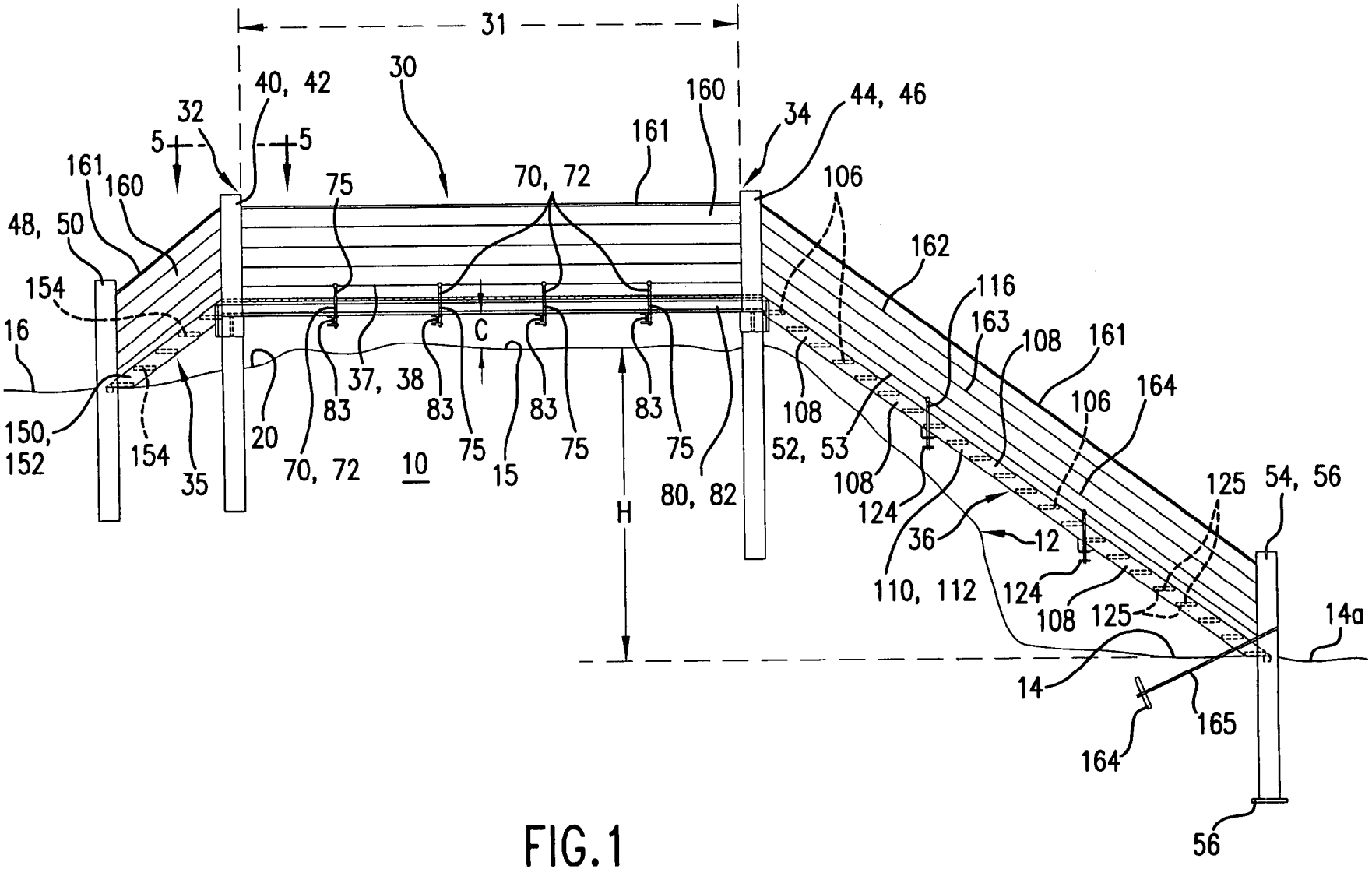
FIG. 1 is a side view of a first embodiment of a dune bridge configured in accordance with the principles of the present invention.
Figure 2:
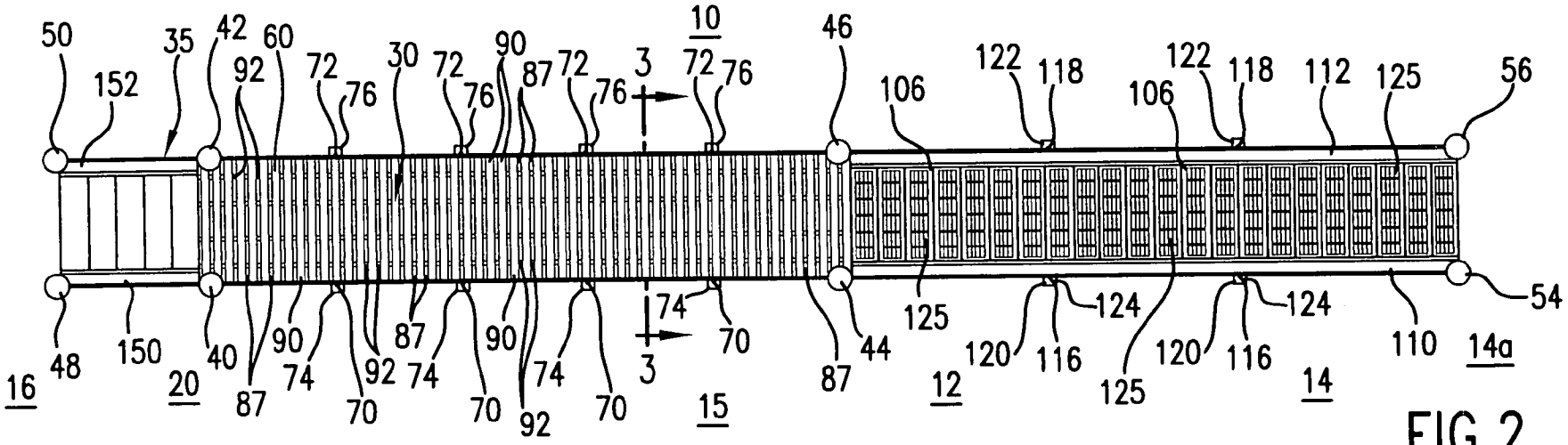
FIG. 2 is a top view of the dune bridge of FIG. 1.

Referring now to FIGS. 1 and 2, a sand dune 10 is shown having a seaward face 12 extending down to a beach 14 from a crest 15. A landward area 16 is behind the dune 10. The landward area 16 may be for example, a park, a road, a building, a deck, a campground, a parking lot, a residential area or any area positioned landward of the dune 10. The crest 15 is at a height H from the beach 14 and has a landward portion 20 that in most situations slopes from the crest toward the landward area 16.

In order to provide beach access from the landward area 16 while minimizing contact with the dune 10, the present invention utilizes a suspension bridge 30 having a span 31 which extends from a first end 32 placed landwardly with respect to the crown 18 of the dune to a second end 34 generally located adjacent to or through the front face 12 of the dune. To avoid direct contact with the dune 10, the suspension bridge 30 is also displaced by a clearance C vertically from the crest 15 of the dune.

The suspension bridge 30 is joined to the landward area 16 by a first ramp 35 extending from the landward area to the first end 32 of the bridge, and is joined to the beach 14 by a second ramp 36 extending from the beach to the second end 34 of the bridge. Preferably, the suspension bridge 30 is supported by a pair of suspension cables 37 and 38 anchored on the landward end to two first pilings 40 and 42 and on the seaward end to two second pilings 44 and 46 placed adjacent or in the front face 12 of the dune 10. The first ramp 35 is anchored at one end to the pilings 40 and 42, respectively, behind the dune 10 and anchored at the other end to pilings 48 and 50 disposed landward of the first pilings 40 and 42. The longer second ramp 36 has suspension cables 52 and 53 anchored at a first end to second pilings 44 and 46, at the front of the dune 10, which suspension cables are anchored at a second end to pilings 54 and 55 in the beach 14. The pilings 54 and 55 each have radially extending plates 56 extending therefrom, which plates each have wet sand bearing there against to minimize the chance of the pilings being lifted from the beach when the beach is under water and the second ramp 36 is pounded by surf.

Figure 3:
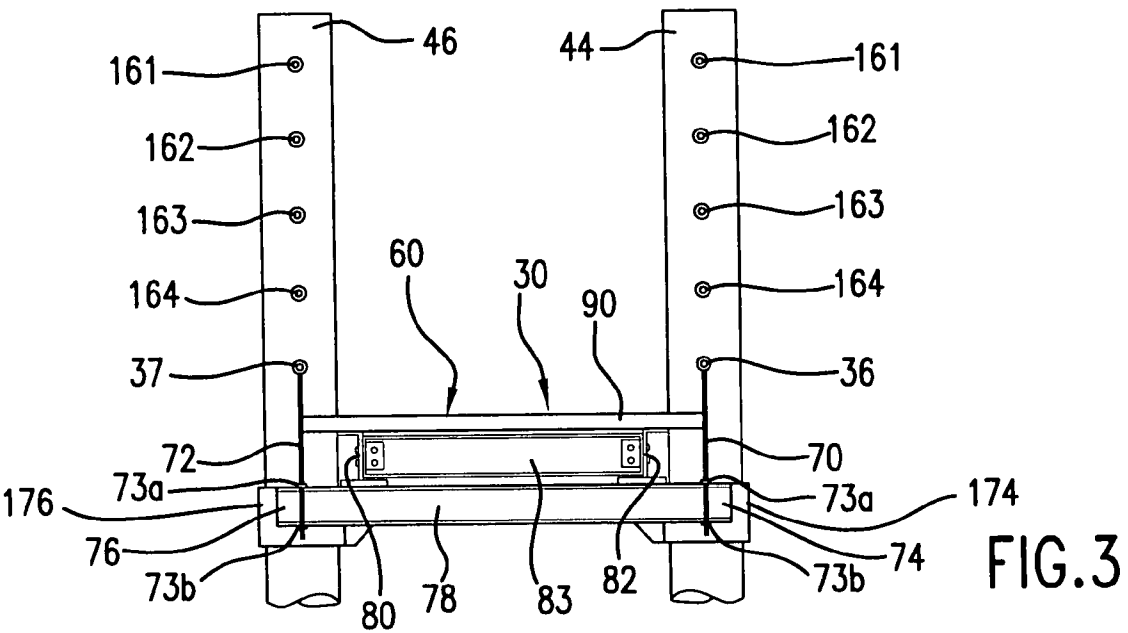
FIG. 3 is an enlarged sectional view taken along lines 3-3 of FIG. 2.

As best seen in FIG. 3 in combination with FIGS. 1 and 2, the cables 37 and 38 supporting the suspension bridge 30 are connected to a deck 60 by hanger rods 70 and 72 extending from the cables 37 and 38. While four hanger rods 70 and 72 are shown in FIGS. 1 and 2, more or fewer hanger rods may be used depending on the span 31 of the suspension bridge 30 and engineering factors such as the bending characteristics of the deck 60. The hanger rods 70 and 72 are preferably made from ½ inch galvanized steel eyebolts with the cables 37 and 38 passing through the eye of the eyebolts and nut and washer fasteners 73*a* and 73*b* scouring each eyebolt shank 75 to cross beams 78.

In the preferred embodiment of the invention, the tensioning rods 70 and 72 are attached to opposite ends 74 and 76 of the cross beams 78, which cross beams support deck stringers 80 and 82. As is seen in FIG. 3, the deck stringers 80 and 82 are longitudinally braced by channel floor beams 83 bolted to the deck stringers.

Figure 4:
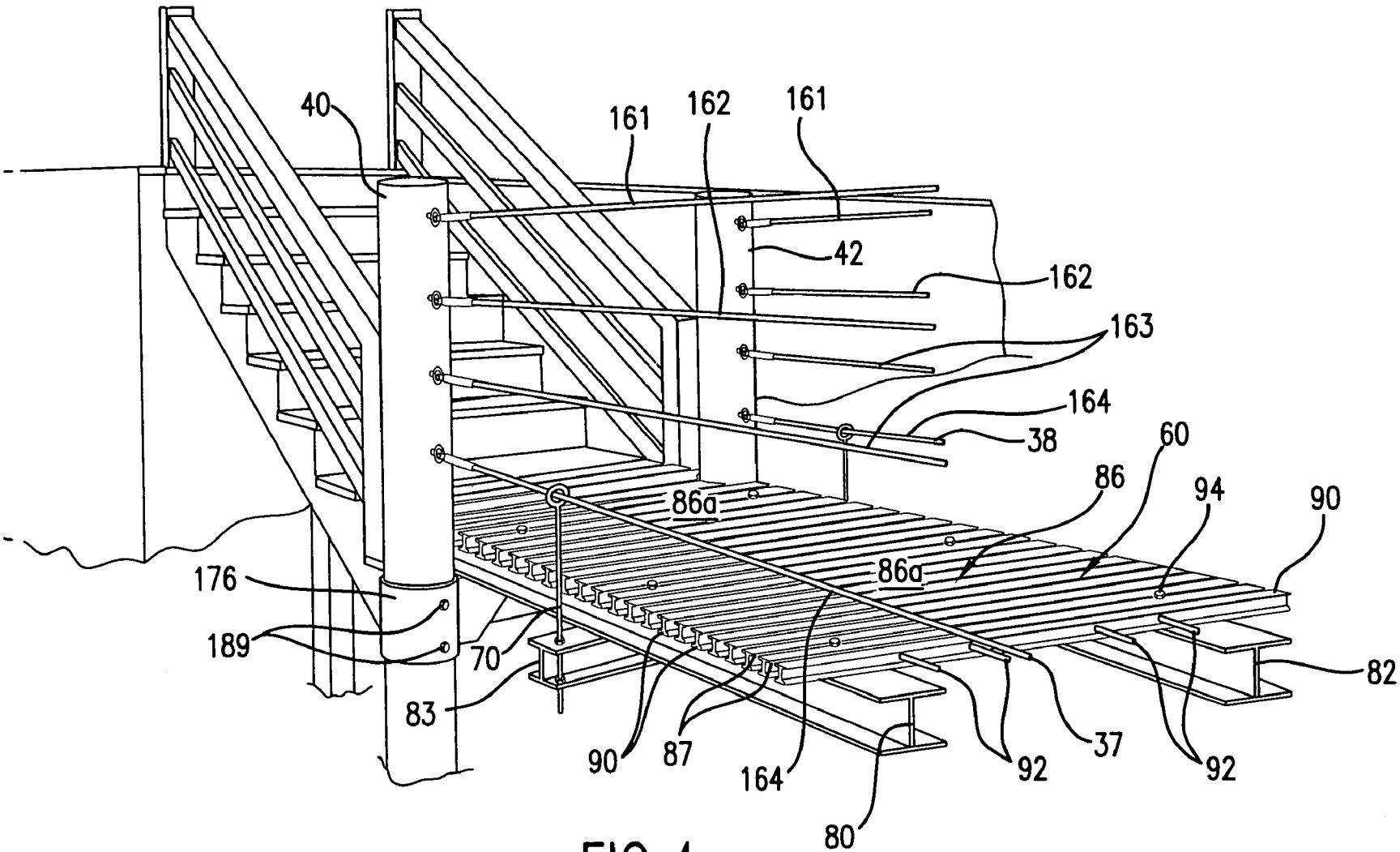
FIG. 4 is a perspective view of a portion of the dune bridge configured as a second embodiment.

Referring now mainly to FIG. 4, the deck stringers 80 and 82 support a series of deck gratings 86 (see also FIG. 2) which form the deck 60. The deck gratings 86 are preferably made of panels of pultruded fiberglass, which have slots 87 therethrough so that sand does not accumulate on the deck 60 but falls through the deck and adds to the dune 10. Moreover, air currents, rain, high tides and waves pass through the slots 87 in the deck grating 86 so as to expose the top surface of the dune 10 to essentially the same environment as portions of the dune not crossed by a bridge 30. Sand which contacts the top surface of the deck 60, whether it be tracked by pedestrians or blown by the wind, will fall through the deck naturally, by foot pressure impacts, by being washed through the openings by rain or by being dislodged by air currents.

The deck gratings 86 are preferably individual panels 86*a*, that are for example, about 4 feet wide and 5 feet long and made up of I-beams 90 that have rods 92 inserted therethrough to hold the I-beams together in spaced relation with the gaps 87 therebetween. The I-beams 90 are preferably made of a polymer composite with a fiberglass core. Bolts 94 through the deck gratings 86 secure the deck gratings to the deck stringers 80 and 82.

While the preferred material for the deck grating 86 is pultruded fiberglass available from Creative Pultrusions, Inc. of Pleasantville, Pa., alternative materials, may be used, such as but not limited to weather and sun resistant polymers, anodized aluminum, rust proofed steel, or spaced pressure treated wooden planks or strips.

Referring again mainly to FIGS. 1 and 2, the seaward ramp 36 extends downwardly from the pilings 44 and 46 at the second end 34 of the suspension bridge 60 and are bolted to the pilings 54 and 56, embedded in a relatively flat portion 14*a* of the existing beach grade. In a preferred embodiment, the ramp 36 utilizes step treads 106 vertically separated by spaces 108 and supported by a pair of stair carriages 110 and 112. Preferably, the stair carriages 110 and 112 are channel stair carriages made of fiberglass and the treads 106 are pultruded fiberglass, deck-grade stair treads with openings therethough available from Creative Pultrusions, Inc. of Pleasantville, Pa.

The stair carriages 110 and 112 are supported from the suspension cables 52 and 53 intermediate the ends of the stair carriages by hanging rods 116 and 118, respectively, which are configured as eyebolts similar to hanging rods 70 and 72, and are attached to the protruding portions 120 and 122 of cross beams 124 that extend beneath the stair carriages 110 and 112. The suspension cables 52 and 53 keep the stair carriages 110 and 112 from sagging between lower end bolted directly to pilings 54 and 56 and upper ends bolted to angles at pilings 44 and 46.

The seaward ramp 36 is configured to minimize the local impact of its presence in front of the dune face 12 and over the existing beach grade 14 by permitting air flow through the spaces 108 between the treads 106 and past the relatively small cross sectional area of the suspension cables 52 and 53. The small cross section of the cross beams 124 and the hanging rods 116 and 118 further minimize the impact of the ramp 56 on the face 12 of the dune 10. Since the treads 106 have openings 125 therethrough, sand and rain pass through the treads, minimizing impact of the treads on the existing beach grade 14, which existing beach grade contributes to the stability of the dune 10.

The landward ramp 35 is preferably similar to the seaward ramp 36, however the landward ramp has less of an impact on the dune 10 than the seaward ramp and could in some situations conceiveably be replaced by inexpensive steps. Since the landward ramp 35 is short, it is shown without tensioning rods, such as the tensioning rods 70 and 72 of the bridge 30 and tensioning rods 116 and 118 of the seaward ramp 36, however if the landward ramp 35 crosses an environmentally sensitive area, then its span can be extended using tensioning rods to support stair carriages 150 and 152 on which treads 154 similar to the treads 106 are supported. Like the seaward ramp 36, the landward ramp 35 may use fiberglass for the stair carriages 150 and 152 and use pultruded fiberglass decking for the treads 154 to allow sand to fall through openings in the treads.

Preferably, safety barriers 160 in the form of tensioned safetycables 161, 162, 163 and 164 are anchored to the pilings 40, 42; 44, 46; 54, 55 and 49, 50 to prevent children from falling from the deck 60 and the landward and seaward ramps 35 and 36. The tensioned safety cables 161-164 are each attached to eyebolts passing through bores in the pilings 40, 42, 44, 46, 54, 55 and 49, 50 and are tensioned by turnbuckles at the ends of the cables which are attached to the eyes. The suspension cables 37, 38 and 52, 53 are also tensioned by turnbuckles at the ends thereof coupled with eyebolts through the pilings with the lengths of the hanger rods 70, 72 also being adjusted to counteract drape of the suspension cables. The top safety cables 161 are for example a ½ inch, plastic sheathed, galvanized steel cable provided with ⅝ inch turnbuckles at the ends. Being relatively thick, the two top safety cables 161 form hand rails. The pairs of safety cables 162, 163 and 164 are ¼ inch, plastic sheathed, galvanized steel cables tensioned at each end with turnbuckles. The safety cables cooperate to form a barrier of safety rails.

As is seen in FIG. 1, a lateral thrust block in the form of a plate 164 is attached to each beach piling 54, 55 by a relatively thick threaded rod 165 to prevent the pilings from being tilted back toward pilings 44 and 46 as turnbuckles on the suspension and safety cables comprising the safety barrier 160 are tightened.

Figure 7:
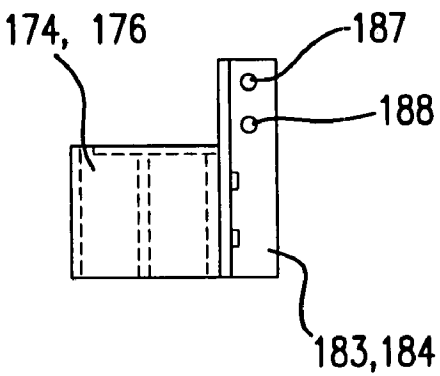
FIG. 7 is an enlarged view taken along lines 7-7 of FIG. 5.
Figure 5:
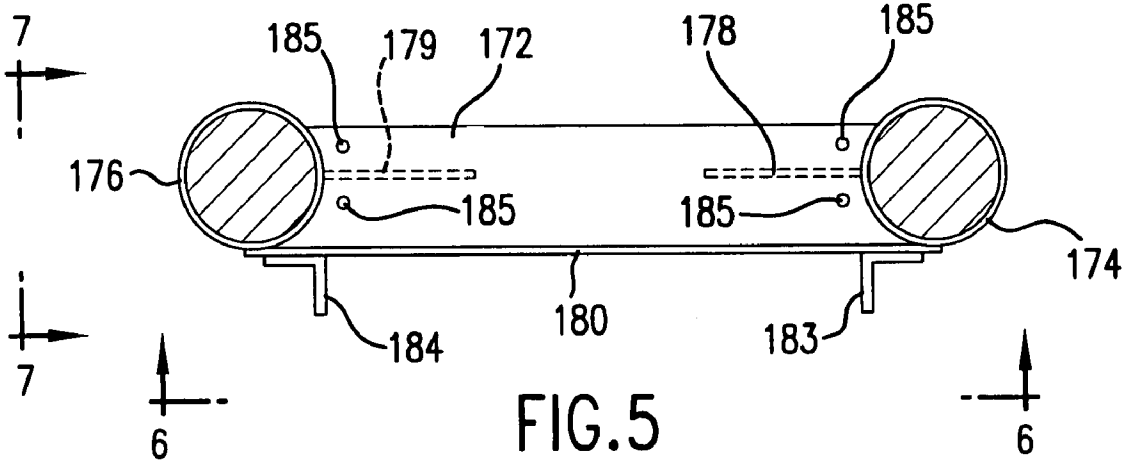
FIG. 5 is an enlarged elevation taken along lines 5-5 of FIG. 1.
Figure 6:
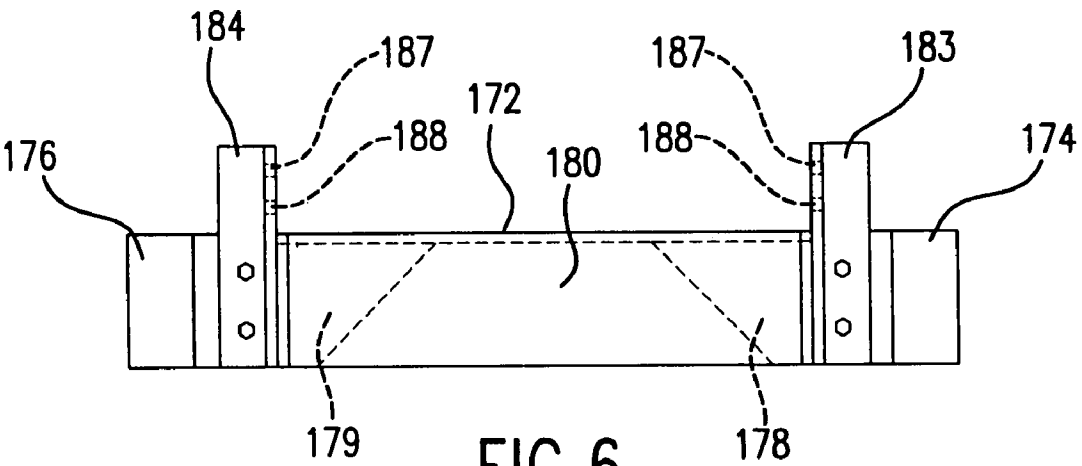
FIG. 6 is an enlarged view taken along lines 6-6 of FIG. 5.

Referring now to FIGS. 5, 6 and 7 a seat bracket 170 is disposed between each of the pilings in at least the pilings pairs 40, 42, and 46, 44 to maintain positioning of the piling pairs. The seat brackets 170 each comprise a horizontal plate 172 that extends between collars 174 and 176 which each have a piling therethrough. The horizontal plate 172 has stiffeners 178 and 179 extending from the collars 174 and 176 and oriented vertically with respect to the lateral plate. A strengthening vertical face plate 180, integral with the horizontal plate 172 and extending perpendicularly along one edge thereof, mounts a pair of angles 183 and 184 to which the risers 110 and 112 and for the seaward ramp 36 and the risers 150 and 152 for the landward ramp 35 are bolted via bolt holes 187 and 188. The stringers 80 and 82, which are configured as I-beams, each have flat lower flanges which abut and are bolted to the flat horizontal surfaces of the horizontal plates 172 of the seat brackets 170 by bolts which pass through the flanges and into bolt holes 185 in the horizontal plates 172. Since bolts 189 (see FIG. 4) bolt the collars 174 and 176 to their respective pilings, the seat brackets 170, stringers 80 and 82 and the decking panels 86 are rigidly secured to the pilings at the ends of the stringers.

The cable suspension then keeps the stringers 80 and 82 from sagging since the span 31 maybe 20 feet or more. The seat brackets 170 are preferably made of a composite polymer, such as, but not limited to fiberglass.

The deck gratings 86 and step treads 106, as well as the underlying support structure comprised of the cross beams 78 and 124, stringers 80 and 82, floor beams 83 and stair carriages 110, 112 and 150, 152 are preferably made of composite materials such as fiberglass pultrusions, such as the fiberglass pultrusions available from Creative Pultrusions, Inc. of Pleasantville Pa. However, other materials may be used, such as but not limited to, rust proof steel, treated wood, anodized aluminum, weather resistant polymers or any other materials which are suitable for outdoor use in a sea side environment.

The pilings 44, 46; 40, 42; 49, 50 and 54, 55 in one embodiment are treated wood pilings which are circular in cross section. The wood pilings include an outer sheath of a polymer material, such as polyvinyl chloride, which is resistant to moisture and abrasion by wind born sand particles. Since the pilings are circular in cross section, the pilings minimize wind and water resistance in any direction. In another embodiment the pilings are made from a composite polymer, such as polypropylene with a filler of for example fiberglass strands, or sand, strengthened by longitudinally extending tensioning rods made of fiberglass. Such pilings are available from Seaward International of Clearbrook, Va., a division of Trelleboard Engineering Products, Inc. The pilings 44, 46; 40, 42; 49, 50 and 54, 55 are for example about 8-8½ inches in diameter.

Referring again to FIG. 4, FIG. 4 discloses a second embodiment 30' of the suspension dune bridge wherein the suspension dune bridge has a landward ramp 35' that is connected to a building or deck 16' which is disposed above the dune bridge. The suspension dune bridge 30' is substantially similar to the suspension dune bridge 30 of FIGS. 1-6 with the exception that the landward ramp 35' descends to the deck 60 and is configured as stair steps of current design. In a third embodiment of the suspension dune bridge 30, landward ramps 35 or 35' are not used and if necessary the deck 60 across the dune 10 is accessed by a couple of steps.

The aforedescribed dune bridges 30 and 30' are designed to replace the conventional pressure treated wood walkways used to provide beach access over natural sand dune lines. The aforedescribed dune bridge 10 employs suspension bridge technology to minimize the number of pilings required to support the structure. This not only provides less structure for storm waves to target and destroy during wave run up, but the geometry of the round piles causes less scouring of the sand from around piles than occurs with the normal wood piles of square cross section. Reduced scouring around the piles reduces the risk of the piles washing out, which could result in the collapse of a portion of the dune bridge. Moreover, reduced scouring around the piles helps preserve the integrity of the dune by reducing the amount of erosion to the face of the dune 10.

The open fiberglass grating used for the deck gratings comprising decking 60 and the stair treads 106 has the advantage over treated wood of not deteriorating, splitting and splintering as it ages and weathers which results in less required maintenance. Additionally, the open grating of the deck grating of the suspension bridge 30 and stair treads 106 allows storm waves to pass through the deck grating and ramps 35 and 36 of the structure dissipating a large portion of the destruction wave energy that damages and destroys conventional timber docks. A further advantage of the open grating is that it allows the wind driven sand to pass freely through the deck and stairs so as to be placed on the dune 10 to allow the natural rebuilding process that preserves the dune to continue relatively uninterrupted. Conventional wood decks tend to trap sand and the trapped sand which when wet, increases the weight on the walkway and can lead to fatigue, premature rotting of the wood and eventual structural failure.

Accumulated sand not only requires removal to maintain safe access across the dune bridge but the trapped sand is also prohibited from reaching the dune 10 and as a result the natural building process is compromised. By using galvanized steel cable sheathed in plastic for the suspension cables that are tensioned horizontally to support vertical loads that the structure must carry, a top rail of the safety railing is also provided as a hand hold that runs continuously along each side of the bridge 30 and ramps 35 and 36. By having a smooth plastic sheathing on the suspension cables, as well as on the secondary safety rail cables 160 a self secure gripping surface that will remain free from splits and splinters that develop in conventional treated wood railings as the railings age and weather.

The relatively small cross section of the cables 37, 38; 161, 162 and 164 is subjected to much less wind and wave force, which also helps to preserve the integrity of the structure during a storm event.

Through scale modern testing, the design as illustrated withstood wave heights equal to ten to twelve feet which are approximately equal to the height of the dunes 10 the suspension bridge 30 is built to cross. A comparable wood structure would have been badly damaged or destroyed once the waves reached the five to six foot height. The dune walk provided by the suspension bridge 30 with its suspension ramps 35 and 36 is not only an improvement over conventional treated wood walkways, but it is much less susceptible to storm wave damage and requires less maintenance to keep safe, as well as reducing the scouring effect of storm waves on the sand dune while allowing the natural dune re-building process to continue with minimal interruption.

In another embodiment of the structure disclosed in this application, the declining gratings 86 are used to configure a pier or dock extending over water. The opening through the decking gratings 86 allowing the passage of waves and currents during periods of high water. In this embodiment of the invention, the stringers 80 and 82 need not be suspended from cables but are supported directly on pilings disposed about 12 feet apart. The stringers 80 and 82 and bolted to the seat brackets 170 of FIGS. 5-7 to form a rigid structure with the pilings. In the pier embodiment, the seaward ramp 36 and landward ramp 35 need not necessarily be used and since the pilings are closer together, the suspension of the stringers 80 and 82 from cables is not required.

From the foregoing description, one skilled in the art can easily ascertain the essential characteristics of this invention, and without departing form the spirit and scope thereof, can make various changes and modifications of the invention to adapt it to various usages and conditions.

What is claimed is:

1. In combination with a sand dune of a height (H) positioned to protect a beach on a seaward side of the sand dune, a suspension bridge extending from a landward side to a seaward side of the sand dune, the combination comprising:

first pilings disposed at least in proximately with the landward side of the sand dune;

second pilings disposed at least in proximately with the seaward side of the sand dune;

suspension cables supported by the first and second pilings;

a bridge deck supported by the suspension cables with a clearance (C) from the crest of the dune, the bridge deck having a seaward end and a landward end so as to substantially avoid contact with the sand dune and having openings therethrough for the free passage of sand, air and water, and a seaward ramp extending without engaging the seaward side of the sand dune from the seaward end of the bridge deck down to the beach protected by the sand dune, the seaward ramp having openings therethrough for the free passage of sand, air and water; whereby erosion damage to the seaward side of sand dune is minimized.

2. The suspension bridge of claim 1 wherein the suspension cables are connected to laterally extending beams positioned beneath the bridge deck by hangers, which laterally extending beams support the bridge deck thereon.

3. The suspension bridge of claim 2 wherein longitudinal stringers are supported on lateral beams and wherein the decking is fixed to stringers to comprise the bridge deck.

4. The suspension bridge of claim 3 wherein the decking is comprised of elongated narrow planks made of a composite material, the elongated narrow planks being separated by gaps to provide the openings.

5. The suspension bridge of claim 4 wherein the planks are I-beams joined to form panels by connecting rods which join a plurality of planks, while holding the planks in spaced relation with respect to one another to provide the gaps.

6. The suspension bridge of claim 5 wherein the seaward ramp comprises treads positioned on risers and having openings through for the free passage of water, sand and air, the risers being supported by cables, each riser having a landward end connected to one of the second pilings and a seaward end connected to one of a third pilings positioned on the beach seaward of the dune.

7. The suspension bridge of claim 5 wherein a landward ramp descends from the first pilings to a landward area.

8. The suspension bridge of claim 7 wherein the landward ramp includes at least one step.

9. The suspension bridge of claim 7 wherein the landward ramp descends from a deck or building to the bridge deck.

10. The suspension bridge of claim 6 wherein the suspension cables are lower cables in arrays of safety cables, which safety cables comprise safety barriers that extend between the first pilings and second pilings, and between the second pilings and third pilings.

11. The suspension bridge of claim 10 wherein the suspension cables and safety cables have tensioners associated therewith.

12. The suspension bridge of claim 11 wherein the beach pilings each have a laterally extending thrust block attached thereto at a location between the beach piling and the dune for resisting forces tending to move the beach pilings toward the dune upon tensioning the cables.

13. The suspension bridge of claim 6 wherein at least the first pilings and the second pilings are held in lateral spaced relation by seat brackets comprising tubular collars which fit around the individual pilings and are each connected by a stiffener plate that extends there between the stiffener plate having a horizontal surface to which the stringers are bolted.

14. the suspension bridge of claim 13 wherein the seat bracket has flanges projecting therefrom for the attachment of risers of ramps.

15. the suspension bridge of claim 1 wherein the pilings are round timber pilings covered by a polymer layer or do pilings comprise a composite polymer.

16. the suspension bridge of claim 1 wherein the decking planks, stringers, risers and steps are fiberglass and the hanger and cables are from steel.

17. The suspension bridge of claim 1 wherein at least the second piling are round in cross section.

18. The suspension bridge of claim 1 wherein at least the second and third pilings are round in cross section.

19. The suspension bride of claim 1 wherein the first pilings and second pilings are the only pilings suspending the suspension cables.

* * * * *

UNITED STATES PATENT AND TRADEMARK OFFICE

CERTIFICATE OF CORRECTION

PATENT NO. : 7,263,736 B2 
APPLICATION NO. : 11/047759
DATED : September 4, 2007
INVENTOR(S) : Harold Goodman et al.

It is certified that error appears in the above-identified patent and that said Letters Patent is hereby corrected as shown below:

Column 6, line 66, reads “proximately” should read -- proximity --
Column 7, line 1, reads “proximately” should read -- proximity --
Column 7, line 16, reads “side of sand dune” should read -- side of the sand dune --
Column 8, line 22, reads “there between the stiffener” should read -- there between, the stiffener --
Column 8, line 24, reads “the suspension bridge” should read -- The suspension bridge --
Column 8, line 27, reads “the suspension bridge” should read -- The suspension bridge --
Column 8, line 30, reads “the suspension bridge” should read -- The suspension bridge --
Column 8, line 37, reads “The suspension bride” should read -- The suspension bridge --

Signed and Sealed this

Fifteenth Day of April, 2008

JON W. DUDAS
*Director of the United States Patent and Trademark Office*